US008630568B2

(12) United States Patent
Yoshie et al.

(10) Patent No.: US 8,630,568 B2
(45) Date of Patent: Jan. 14, 2014

(54) LIQUID DEVELOPMENT APPARATUS AND CLEANING METHOD THAT CONTROL EITHER A GAP BETWEEN A POOL FORMING MEMBER AND A SUPPLY ROLLER OR A SUPPLY RATE OF A CLEANING LIQUID

(75) Inventors: Naoki Yoshie, Ibaraki (JP); Yuji Kamoda, Ibaraki (JP); Keiko Momotani, Ibaraki (JP); Kazuko Fukumoto, Ibaraki (JP); Yasuo Shirodai, Nara (JP); Eiji Tabata, Ibaraki (JP)

(73) Assignee: Konica Minolta Holdings, Inc., Tokyo (JP)

( * ) Notice: Subject to any disclaimer, the term of this patent is extended or adjusted under 35 U.S.C. 154(b) by 346 days.

(21) Appl. No.: 13/036,679

(22) Filed: Feb. 28, 2011

(65) Prior Publication Data

US 2011/0217081 A1 Sep. 8, 2011

(30) Foreign Application Priority Data

Mar. 3, 2010 (JP) ..... 2010-046262
Feb. 10, 2011 (JP) ..... 2011-026840

(51) Int. Cl.
*G03G 15/10* (2006.01)

(52) U.S. Cl.
USPC ..... 399/238

(58) Field of Classification Search
USPC ..... 399/238, 237, 239, 245, 249
See application file for complete search history.

(56) References Cited

U.S. PATENT DOCUMENTS 5,561,264 A * 10/1996 Iino et al. ..... 399/240

FOREIGN PATENT DOCUMENTS

| | | | |
|---|---|---|---|
| JP | 58-092565 | 6/1983 | |
| JP | 08044217 A * | 2/1996 | ..... G03G 15/11 |
| JP | 11-300940 | 11/1999 | |
| JP | 2004-085958 | 3/2004 | |
| JP | 2007-148243 | 6/2007 | |

* cited by examiner

*Primary Examiner* — Billy J Lactaoen
(74) *Attorney, Agent, or Firm* — Brinks Gilson & Lione

(57) ABSTRACT

Provided is a liquid development apparatus having a constitution in which liquid developer containing carrier liquid with toner dispersed therein is supplied from a liquid developer/cleaning liquid supply member on a pool forming member arranged facing to a supply roller so as to form a pool of the liquid developer, from which pool the liquid developer is supplied to the supply roller, wherein a liquid developer/cleaning liquid supply member supplies cleaning liquid on a pool forming member to form a suitable pooling portion of the cleaning liquid and the liquid developer remaining on the surface of the supply roller is removed and cleaned.

19 Claims, 13 Drawing Sheets

LIQUID DEVELOPMENT APPARATUS AND CLEANING METHOD THAT CONTROL EITHER A GAP BETWEEN A POOL FORMING MEMBER AND A SUPPLY ROLLER OR A SUPPLY RATE OF A CLEANING LIQUID

This application is based on Japanese Patent Applications No. 2010-046262 filed on Mar. 3, 2010, and No. 2011-26840 filed on Feb. 10, 2011, in Japanese Patent Office, the entire content of which is hereby incorporated by reference.

BACKGROUND OF THE INVENTION

1. Field of the Invention

The present invention relates to a liquid development apparatus for developing a latent image by using liquid developer comprising liquid carrier and toner dispersed therein to form a toner image. In particular, the present invention relates to a liquid development apparatus provided with a supply roller for supplying liquid developer, a pool forming member to form a pool to supply the liquid developer to said supply roller, and a cleaning liquid supply member.

2. Description of the Related Art

There is widely used an image forming apparatus using an electrophotographic method in which an electrostatic latent image is formed on a photoconductor (an image carrier), toner is made to adhere thereon, and the image is then transferred and fixed on paper and the like. In particular, in an image forming apparatus such as an office printer and an on-demand printing apparatus for large scale printing, which require higher image quality and higher resolution, used is a wet type developing method using liquid developer which contains toner with a small particle size and hardly causes unevenness in toner images.

In recent years, an image forming apparatus using a wet type developer having a high viscosity and a high concentration, which developer is constituted by an insulating liquid "carrier liquid" such as silicone oil and by toner, as a solid composition comprising resin and pigment, dispersed in the insulating liquid at a high concentration.

At the time of development by using this wet type developer, development is generally conducted by forming a thin developer layer in micrometers on a developer carrier such as a development roller and by bringing this thin developer layer in contact with a photoconductor.

Further, disclosed is a constitution in which one or more supply rollers for supplying liquid developer to a development roller are arranged.

Generally, liquid developer is made to be carried on the supply roller after being directly supplied from a liquid developer supply member to the supply roller, or by using as the supply roller a draw-up roller immersed in a liquid developer reservoir.

The carried liquid developer is regulated in conveying amount by a regulation blade and the like, and supplied to a development roller. As a draw-up roller, generally used is a constitution in which the liquid amount is controlled by grooves formed on a surface of a roller and is regulated by pressing a regulation blade to a roller, as done with an anilox roller.

However, in such a constitution, there is caused a problem that the toner stacked in the grooves and the like of an anilox roller causes the variation of the regulation amount. In particular, the problem becomes serious when toner is dried with evaporation of carrier liquid.

As a method to restrain the problem due to such a residual liquid developer, proposed is a method to provide a cleaning operation and to separate a blade and a roller (for example, Japanese Laid-open Patent Application Publication No. 2007-148243) or to electrically remove the residual toner (for example, Japanese Laid-open Patent Application Publication No. 2004-85958) at the time of cleaning. Further, as for a printing apparatus, proposed has been a cleaning method to flow a cleaning liquid all over the apparatus (for example, Japanese Laid-open Patent Application Publication Nos. S58-92565 and H11-300940).

As described above, in the case of using liquid developer comprising carrier liquid and toner dispersed therein, there is especially a concern that toner may be dried due to evaporation of the carrier liquid. Toner is most easily accumulated in the grooves of an anilox roller or at the contact site, of the anilox roller, being in contact with the tip portion of a regulation blade.

That is, since the liquid developer is dammed up with the blade, a liquid pool is formed on the upstream side of the tip portion.

When the liquid developer is pooled, it makes a highly viscous toner pool having a high toner concentration will be locally generated, which is hard to be removed. Further, if it dries during the machine stops, the liquid pool at the tip portion of the blade will be dried, accordingly it will be harder to be removed.

When toner not haying been removed is accumulated, the accumulated toner may be packed in the grooves and vary the regulation amount or generate a noise, of traces of the grooves, on images.

There need to be measures to prevent the toner from being accumulated at the portion where liquid developer likely remains, or to make it easy to remove the accumulated matters which have been accumulated and dried.

In the techniques disclosed in Japanese Laid-open Patent application Publication Nos. 2007-148243, 2004-85958, S58-92565 and H11-300940, cleaning may be insufficient for the portions where the liquid developer is likely pooled or the pooled matters give a large influence on image quality, therefore the roller needs to have a disconnection mechanism, or a bias source or a large scale cleaning liquid supplying means needs to be provided.

In particular, Japanese Laid-open Patent Application Publication Nos. S58-92565 and H11-300940 are for cleaning offprinting ink, and the constitution is often made to clean the whole apparatus in a large scale, which is different from an image forming apparatus of an electrophotographic method.

SUMMARY OF THE INVENTION

An object of this invention is to provide a liquid development apparatus, in which liquid developer comprising carrier liquid and toner dispersed therein is supplied on a pool forming member arranged facing a supply roller to form a pool of the liquid developer, from which pool the liquid developer is supplied to the supply roller, wherein contamination of liquid developer can be efficiently removed, thereby reducing the variation in a regulation amount of the liquid developer and bad effects on image quality.

In view of forgoing, one embodiment according to one aspect of the present invention is a liquid development apparatus comprising;

a development roller configured to carry on a surface thereof a liquid developer including a carrier liquid and toner particles dispersed therein, and to convey the liquid developer onto an image carrier to develop an electrostatic latent image formed on the image carrier;

a supply roller configured to carry on a surface thereof the liquid developer and supply the liquid developer onto the development roller;

a pool forming member provided facing the supply roller, and configured to form a pool of the liquid developer or the cleaning liquid thereon to supply the liquid developer or the cleaning liquid onto the supply roller, respectively;

a cleaning liquid supply member configured to supply the cleaning liquid onto the pool forming member to form a pool of the cleaning liquid thereon, thereby performing a cleaning operation in which the cleaning liquid is supplied to the pool forming member to form the pool of the cleaning liquid thereon so as to clean and remove the liquid developer remaining on the surface of the supply roller at a certain time while a development operation to develop an electrostatic latent image with the liquid developer is not performed.

According to another aspect of the present invention, another embodiment is a method of cleaning a supply roller for carrying and conveying a liquid developer including a carrier liquid and toner particles dispersed therein, toward an image carrier to develop an electrostatic latent image formed on the image carrier, the liquid developer being supplied to the supply roller by forming a pool of the liquid developer on a pool forming member facing the supply roller so that the pool of the liquid developer contacts the supply roller, said method comprising the steps of:

supplying a cleaning liquid onto the pool forming member in place of the liquid developer to form a pool of the cleaning liquid on the pool forming member so that the pool of the cleaning liquid contacts the supply roller, and rotating the supply roller to convey the cleaning liquid carried thereon.

These other objects, advantages and features of the invention will become apparent from the following description thereof taken in conjunction with the accompanying drawings, which illustrate specific embodiments of the invention.

DETAILED DESCRIPTION OF THE PREFERRED EMBODIMENTS

An embodiment of a liquid development apparatus according to the present invention will be described in reference to the drawings.

(Constitution and Operation of Image Forming Apparatus)

Figure 1:
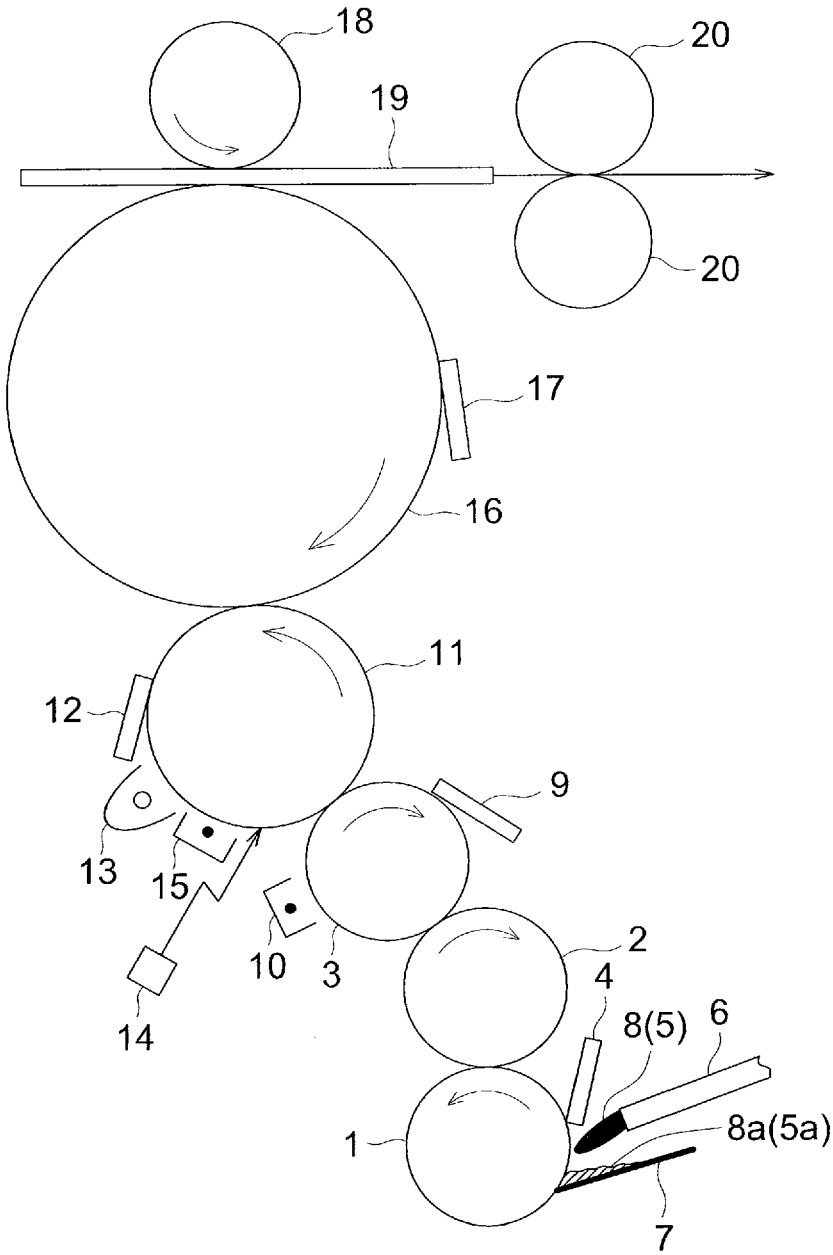
FIG. 1 is a drawing of a schematic constitution showing a constitution example of a wet type image forming apparatus equipped with a liquid development apparatus according to an embodiment.

FIG. 1 is a drawing of a schematic constitution showing an schematic configuration example of a wet type image forming apparatus equipped with a liquid development apparatus according to this embodiment. First, using FIG. 1, an example of a schematic configuration and image forming motion of a wet type image forming apparatus equipped with a liquid development apparatus according to this embodiment will be explained.

In FIG. 1, around image carrier 11 in a drum shape, arranged area charger 15, an exposure apparatus 14, an eraser 13 and an image carrier cleaning blade 12. Reference numeral 16 denotes an intermediate transfer member, which is equipped with a cleaning blade 17.

The surface of the image carrier 11 is uniformly charged to a predetermined surface potential by the charger 15, and thereafter, image information is exposed by the exposure apparatus 14 to form an electrostatic latent image on the surface of the image carrier 11.

Next, the electrostatic latent image on the image carrier 11 is developed by a development roller 3 with liquid developer 8, which contains toner and carrier liquid, to form a toner image on the surface of the image carrier 11. At this time, the liquid developer 8, which contains not only the toner but the carrier liquid, adheres to the surface of the image carrier 11.

Next, the toner image on the image carrier 11 is primarily transferred onto an intermediate transfer member 16 by a predetermined voltage applied to the intermediate transfer member 16. The intermediate transfer member 16 is supplied with a voltage with a polarity opposite to that of the toner, and has a potential difference of 300 V to 3 kV with respect to the image carrier 11.

After the primary transfer to the intermediate transfer member 16, the liquid developer 8 remaining on the image carrier 11 is removed by an image carrier cleaning blade 12, the charge thereon is removed by an eraser 13, and the image carrier 11 is then subjected again to the latent image formation.

The form of the intermediate transfer member 16 may be either a roller or a belt. The material of the intermediate transfer member 16 is resin or an elastic body and is preferably an elastic body in consideration of transferring ability onto rough paper. The volume resistance is preferably not less than $10^6$ Ωcm and not more than $10^{12}$ Ωcm, and the surface resistance is preferably not less than $10^6$Ω/□ and not more than $10^{12}$Ω/□.

The resin includes polyester, polypropylene, polyamide, polyimide, fluorine type resin, polyphenylsulfate, and the like; and an elastic body includes silicone rubber, fluorine rubber, EPDM, urethane rubber, nitrile rubber, and the like, however, they are not limited thereto.

Further, the outermost surface layer is required to have excellent durability and releasing ability, and therefore the surface layer is preferably comprised of resin. As resin for the surface layer, there are used polyester resin, urethane resin, acryl resin, and the like; however, it is preferable to provide a hard layer of not more than 1 μm which comprises a low-surface-energy polymer such as a fluorine type and a silicone type or is treated by a plasma treatment.

The liquid developer (toner image) having been transferred to the intermediate transfer member 16 is transferred onto a recording medium 19 by a secondary transfer roller 18. To the secondary transfer roller 18, applied is a voltage with a polarity opposite to that of the toner.

The toner image on the recording medium 19 is fixed by a heat roller 20 of a fixing device.

After the transfer to the recording medium 19, the liquid developer 8 remaining on the intermediate transfer member 16 is removed by the cleaning blade 17.

(Constitution and Operation of Liquid Development Apparatus)

Figure 2:
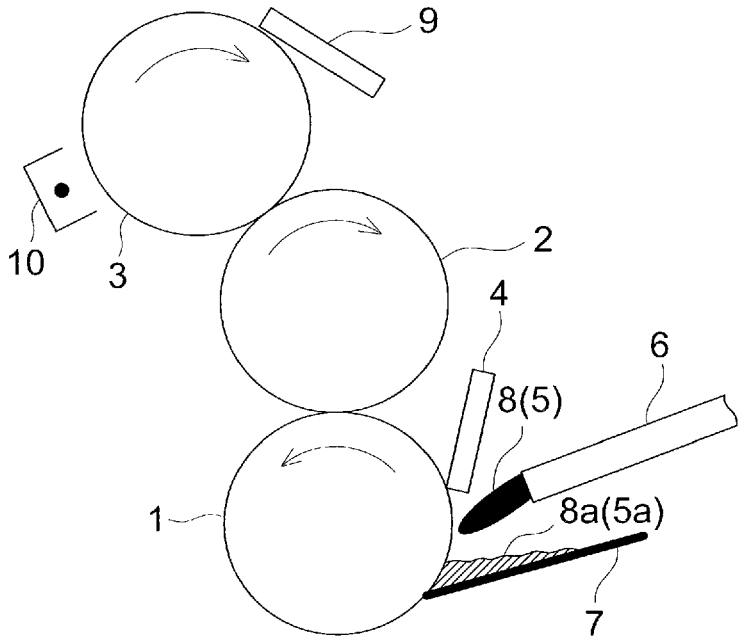
FIG. 2 is a drawing of a schematic constitution showing a constitution example of a liquid development apparatus with which the image forming apparatus of FIG. 1 is equipped.

FIG. 2 is a drawing of a schematic constitution showing a schematic configuration of the liquid development apparatus according to this embodiment with which a wet type image forming apparatus of FIG. 1 is equipped. In reference to FIG. 2, an example of a schematic configuration and operation of the liquid development apparatus according to this embodiment will be described.

In FIG. 2, reference numeral 1 denotes a first supply roller, reference numeral 2 denotes a second supply roller, reference numeral 3 denotes a development roller, and reference numeral 4 denotes a regulation blade.

The liquid developer 8, which is comprised of earner liquid and toner dispersed therein, is supplied to a pool forming member 7 from a liquid developer supply member 6. The liquid developer 8 will be detailed later.

The pool forming member (hereinafter, referred to as a pool forming blade) 7 is arranged facing the first supply roller 1. There is formed a liquid pool 8*a* of the liquid developer 8 which has been supplied from the liquid developer supply member 6 between the pool forming blade 7 and the first supply roller 1. The liquid developer 8 is supplied by bringing this liquid pool 8*a* in contact with the surface of the rotating first supply roller 1. Generally, a small gap is kept between the pool forming blade 7 and the first supply roller 1 to prevent the pool forming blade 7 from being in frictional contact with the first supply roller 1. However, the liquid developer 8 has a certain viscosity and is conveyed upward along with the rotation of the first supply roller 1. Therefore, the amount of the liquid developer 8 leaking through the gap is small, and the liquid pool 8*a* of a certain amount of the liquid developer is formed on the pool forming blade 7, and thus the liquid developer 8 is supplied to the supply roller 1. Herein, the liquid developer 8 having leaked through the gap may be collected in a recovery bath for muse.

The amount of the liquid developer 8 conveyed on the first supply roller 1 is regulated by a regulation blade 4 arranged facing the first supply roller 1.

As the first supply roller, an anilox roller having grooves on the surface thereof is used, and the amount of a liquid developer for a development region can be accurately controlled. Although the appropriate depth of grooves depends on the amount of the liquid developer required for the development region, it is preferably not less than 10 μm and not more than 100 μm in general.

The liquid developer 8, whose amount has been regulated, on the first supply roller (anilox roller; hereinafter, additional description of "anilox roller" will be omitted) 1 is conveyed along with the rotation, and is transferred to the second supply roller 2.

The second supply roller 2 further rotates and conveys the liquid developer 8 which has been received from the first supply roller 1, and supplies the liquid developer to the development roller 3.

The surface material of the development roller 3 and the second supply roller 2 is preferably rubber, the rubber thickness is preferably not less than 1 mm and not more than 20 mm, and the rubber hardness is preferably 10 to 70 degree (JISA). Further, materials of the rubber include urethane rubber, silicone rubber, NBR, CR rubber, fluorine rubber, and the like. The surface layer is coated with resin and the like if necessary. The volume resistance is approximately $10^4$ to $10^{12}$ Ωcm.

The second supply roller 2 and the development roller 3 rotate with their surface in the opposite directions to each other at the nip portion. The rotation may be in the same direction; however, the rotation in the opposite directions allows the most part of liquid developer 8 on second supply roller 2 to be efficiently transferred to the development roller 3. Further, the thin layer of the liquid developer 8 on the development roller 3 is uniform.

The supply amount of the liquid developer 8 to the development roller 3 per unit time depends on the rotation speed of the second supply roller 2, and the amount of the liquid developer 8 on the development roller 3 can be accordingly controlled.

Since the first supply roller 1 is driven by the second roller 2, the change of the rotation speed of the supply roller 2 similarly changes the rotation speed of the first supply roller. In particular, the amount of the liquid developer 8 on the development roller 3 increases when the rotation speed of the second supply roller 2 is increased.

Further, there is provided a charge applying member 10, which charges toner in advance to development, facing the development roller 3. In FIG. 2, the charge applying member is a corona charger; however, the charge may be applied by a contacting member, for example, a roller, a blade, or the like The thin layer of the liquid developer 8, in which the toner has been charged by the charging applying member 10, is conveyed, along with the rotation of the development roller 3, to the nip portion between the development roller 3 and the image carrier 11, and the toner is transferred (development) by the potential difference between the surface potential of the image carrier 11 and the surface potential of the image carrier 11 (the electrostatic latent image) to form a toner image on the image carrier 11.

Herein, in FIG. 2, there is arranged a liquid developer supply member 6 for an operation to supply the liquid developer 8 to the pool forming blade 7. This operation is an operation during a general development operation for image formation, and in a cleaning operation (a operation to supply a cleaning liquid 5 from the above-described liquid developer supply member 6 to form a liquid pool 5*a* on the pool forming blade 7 and to conduct cleaning), the cleaning liquid 5 is supplied to form the liquid pool 5*a* of the cleaning liquid 5 on the pool forming blade 7 to clean the surface of the first supply roller 1; that is, the liquid developer supply member functions as the cleaning liquid supply member. Therefore, this member is referred to as liquid developer/cleaning-liquid supply member 6.

Of course, the liquid developer supply member 6 may not be used as the cleaning liquid supply member, instead a cleaning liquid supply member may be provided in addition to the liquid developer supply member 6. In the case of separately arranging the cleaning liquid supply member, it is possible to arrange the cleaning liquid supply member parallel to and above the liquid developer supply member 6. In the case of using the liquid developer supply member 6 also as the cleaning liquid supply member, it is not necessary to provide plural members and a merit in cost and space can be obtained. Further, there is an advantage that liquid developer remaining and adhering inside the liquid developer/cleaning-liquid supply member 6 can be also cleaned to prevent clogging inside the member.

Figure 3:
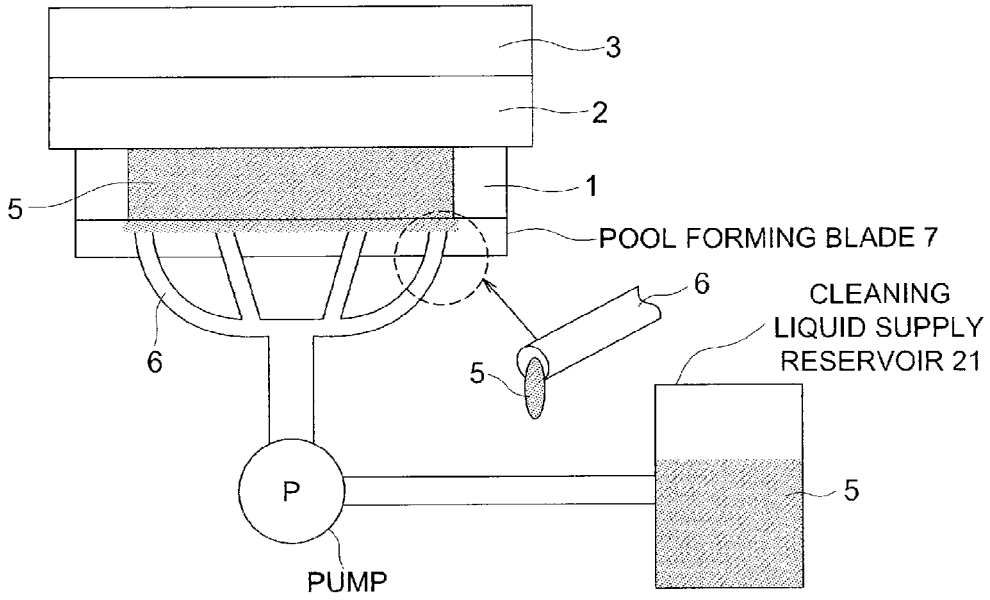
FIG. 3 is a plan view of a drawing of a schematic constitution of a liquid development apparatus.

FIG. 3 is a plan view of a liquid development apparatus of FIG. 2. In FIG. 3, the cleaning liquid 5 is pumped up by a pump and is sent to liquid developer/cleaning-liquid supply member 6. The liquid developer/cleaning-liquid supply member 6 has plural nozzles, and the cleaning liquid 5 is ejected on the pool forming blade 7 through these nozzles. By forming the liquid pool 5*a* of the cleaning liquid 5 on the pool fanning blade 7 and bringing the liquid pool 5*a* in contact with the first supply roller 1, the cleaning liquid 5 is supplied to the supply roller 1.

The supply amount of the liquid developer 8 supplied by the liquid developer/cleaning-liquid supply member 6 depends on whether there are seals on the both ends of the liquid pool 8*a*, and the liquid developer 8 is supplied at a supply rate of approximately 0.05 to 5 L/min.

The liquid pool forming blade 7 is constituted by metal, resin, rubber, or the like, and the gap between the pool forming blade 7 and the first supply roller 1 is approximately 0.1 to 5 mm. At the time of image formation, the gap is preferably approximately 0.5 to 1.5 mm.

Generally, the cleaning liquid 5 has a viscosity lower than the liquid developer 8 and is easily spread, and it may be easily leaked through the both ends of the pool forming blade 7. When the both end parts of the pool forming blade 7 are sealed, the leakage through the both end parts of the pool forming blade 7 hardly happens; however, it is not absolutely necessary to seal the both end parts. The leaked liquid developer 8 can be collected to be used again.

Figure 4:
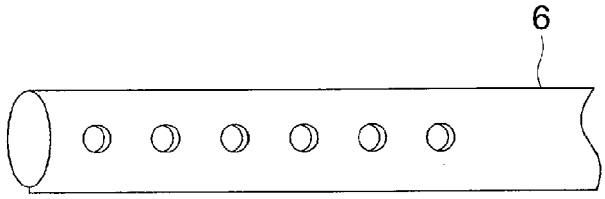
FIG. 4 is a diagram showing a form example of a cleaning liquid supply member 6.

The form of the liquid developer/cleaning-liquid supply member 6 is not limited to that of FIG. 3. The point is to intensively supply the cleaning liquid to a required portion. For example, as shown in FIG. 4, a cylindrical pipe with plural holes provided thereon can be used, and the cleaning liquid will be ejected through the holes. The size of holes is preferably from 0.5 to 5 mm. Alternatively, a cylindrical pipe with an elongated slit provided along its axis may be used, and ejection through this slit will be conducted.

In the following, a cleaning operation will be explained.

(Configuration and Operation for Cleaning)

In the above description, a configuration and operation of a liquid development apparatus according to this embodiment has been explained mainly with respect to operation at the time of image formation (operation during development). However, in a conventional form of a wet type image forming apparatus (a liquid development apparatus), there are caused many problems when image formation (development operation) is repeated. For example, the liquid developer 8 will be accumulated on various members such as the first supply roller 1 and the regulation blade 4, being in contact with the liquid developer 8.

In this embodiment, the liquid developer 8 is most easily accumulated on the portion of the pool forming blade 7, facing the first supply roller 1, on which portion the liquid pool 8*a* of the liquid developer 8 is formed (FIG. 2).

When the toner is accumulated on this portion, the toner gets clayey in an extreme case, and it is difficult to be removed. If the clayey toner may get dried during non-operating period of the apparatus, it may cause clogging of an anilox roller. When the clogging of the anilox roller is caused, it may be difficult to control the conveying amount of the liquid developer 8, or an image noise may be caused due to the clogging of the anilox roller.

To solve this problem, a liquid development apparatus of this embodiment adopts functions and configuration to enable conducting a cleaning operation during non-image forming operation (during the non-development operation).

In particular, it is easy to understand the intention of an embodiment using a operation for cleaning by forming the liquid pool 5*a* of the cleaning liquid 5, if compared with a state of cleaning of printing ink which is proposed in above described Japanese Laid-open Patent application Publication Nos. S58-92565 and H11-300940

The difference between a liquid developer comprising carrier liquid and toner dispersed therein and printing ink is that a resin component is dissolved in a solvent in the case of printing ink while a resin component is not dissolved but is dispersed in the case of liquid developer.

Therefore, in the case of printing ink, when the resin dissolved in solvent once precipitates and is solidified, it is difficult to remove it by simply immersing in cleaning liquid. That is, in order to clean the printing ink, it is often needed to employ a configuration for cleaning a whole apparatus in a large scale.

On the other hand, in the case of cleaning liquid developer, even when toner gets agglutinated or dried, the toner can be removed by cleaning by immersing in cleaning liquid (carrier liquid).

This cleaning operation may be performed either after or before the image-forming operation of an image forming apparatus, or may be performed at a predetermined timing within a non-image-forming time (during the non-development operation), which is made by stopping the operation at an appropriate timing during the operation, for example.

For example, an example of an appropriate setting of timing is as follow.

Figure 5:
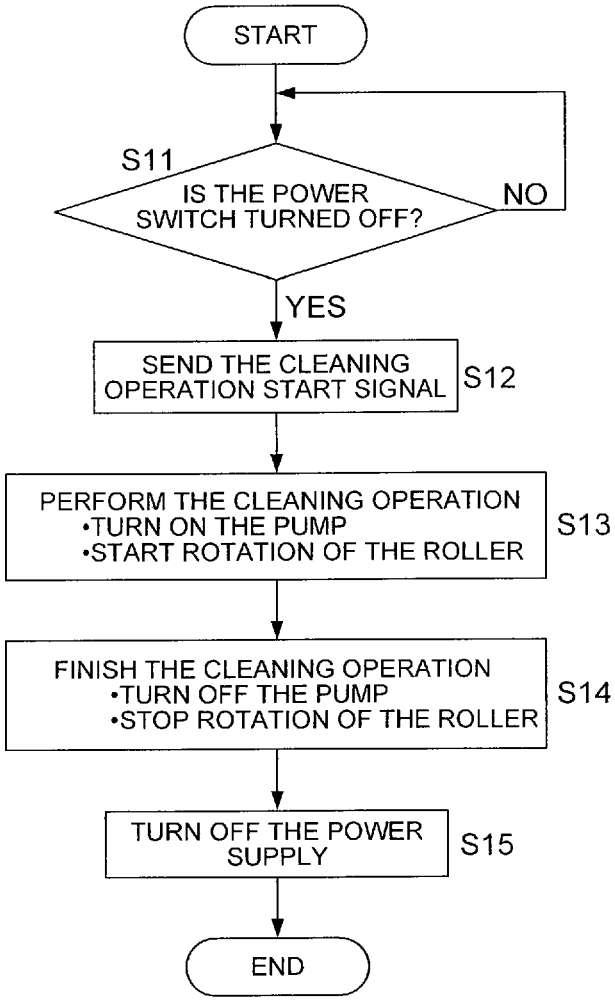
FIGS. 5-9 are flow charts showing a timing of cleaning.

(a) In the flow of FIG. 5, when a user turns off a power switch of the image forming apparatus in step S11, a signal to turn on the cleaning operation is sent, from a CPU described later, to a member to drive a pump (hereinafter "drive member"), a valve, and the like in step S12, and a cleaning operation is conducted in step S13 in response to this signal. After the cleaning is conducted for a predetermined time, the cleaning operation is finished in step S14 and a power supply is turned off in step S15.

Figure 6:
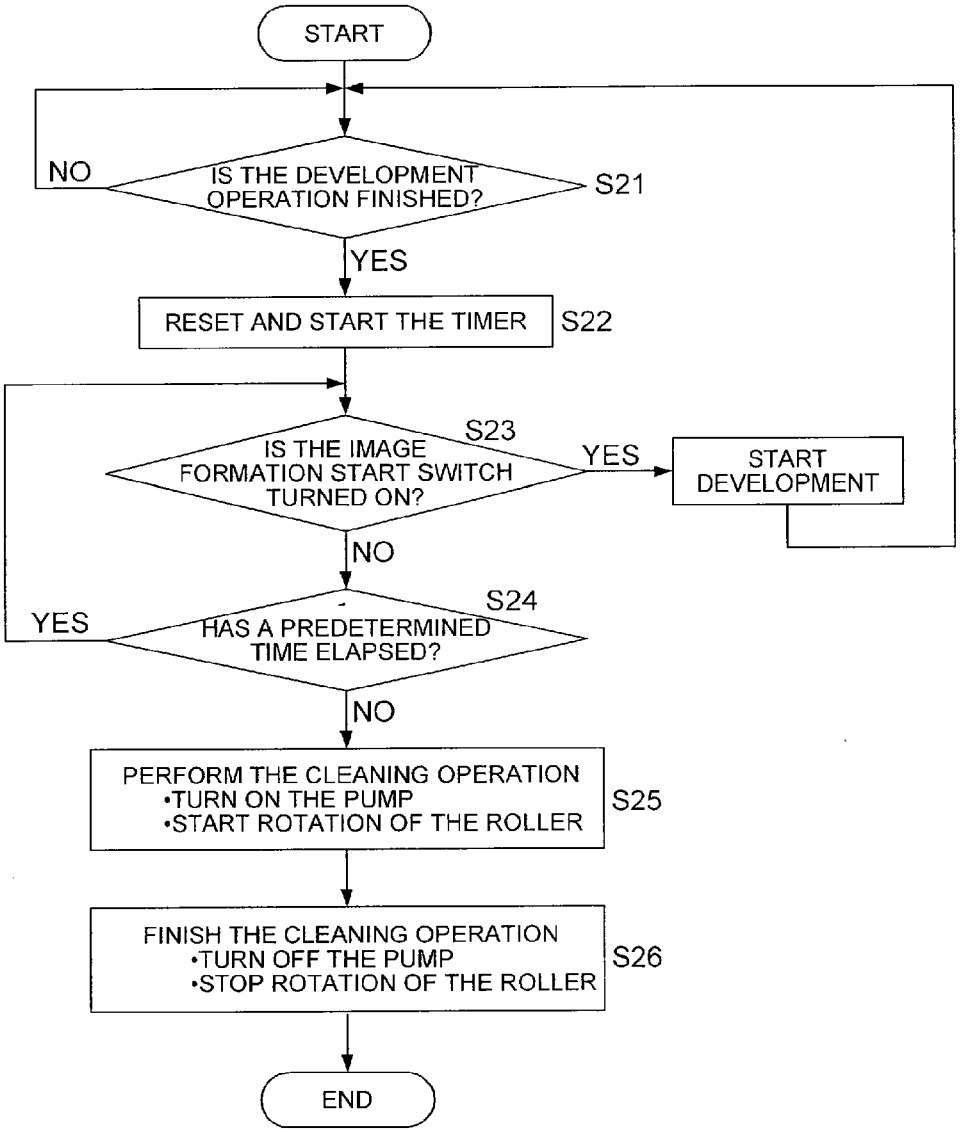

(b) In the flow of FIG. 6, when image formation (development operation) has been finished in step S21, a timer is reset and started in step S22 to measure a lapse of time since the end of image formation (development operation). When a user turns on an image formation start switch (a print start switch) before a predetermined time passes since the timer has been reset and started in step S23, the timer will be reset and started again at the time of the end of that image formation (development operation). On the other hand, when a predetermined time has elapsed without development switch being turned on in step S24, the cleaning operation is started in step S25. The predetermined time is preferably not shorter than 5 minutes and not longer than 120 minutes. The reason is follows. When next development operation does not start in 5 minutes after finishing the latest development operation, it is considered that the development operation has been once suspended and a cleaning operation does not seem to affect the next development. On the other hand, when 120 minutes time period or more has elapsed after finishing the latest development operation, the liquid developer 8 accumulated on various members is dried and is difficult to remove, and therefore it is preferable to start cleaning operation within 120 minutes.

Figure 7:
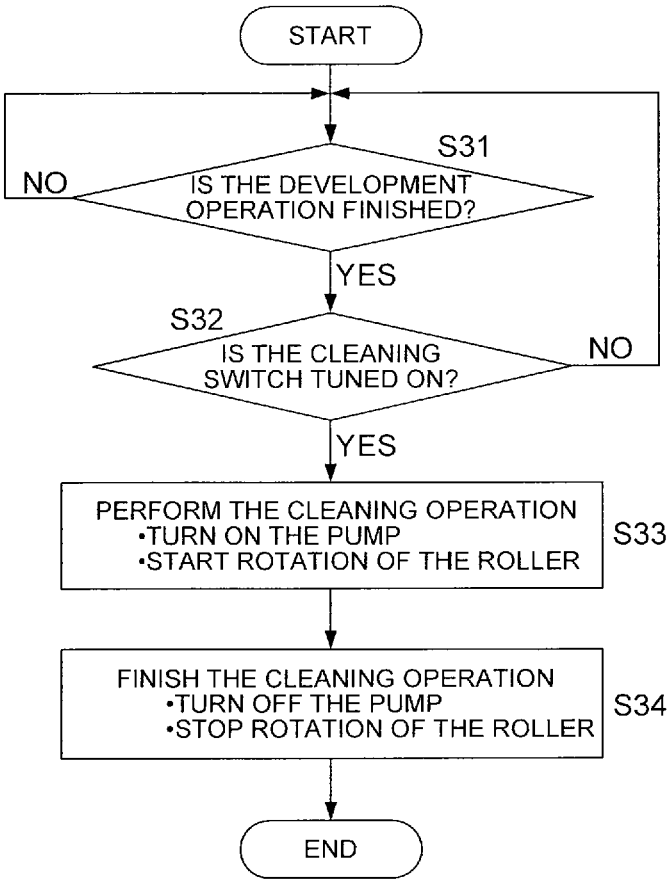

(c) In the flow of FIG. 7, when the image formation (development operation) is finished in step S31 and a user turns on a cleaning switch in step S32, a cleaning operation is conducted in step S33. And after a cleaning operation is performed for a predetermined time period, the cleaning operation is finished in step S34.

Figure 8:
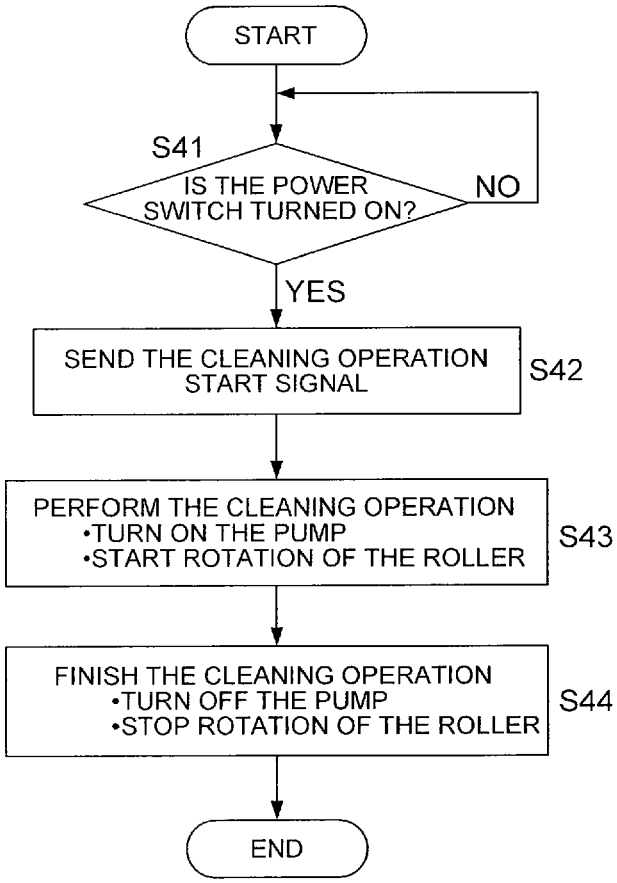

(d) In the flow of FIG. 8, when a user turns on the power switch of the image forming apparatus in step S41, a signal to turn on a cleaning operation is transmitted to the drive member in step S42 to conduct a cleaning operation in step S43. And, when cleaning has been conducted for a predetermined time period, the cleaning operation is finished in step S44.

Figure 9:
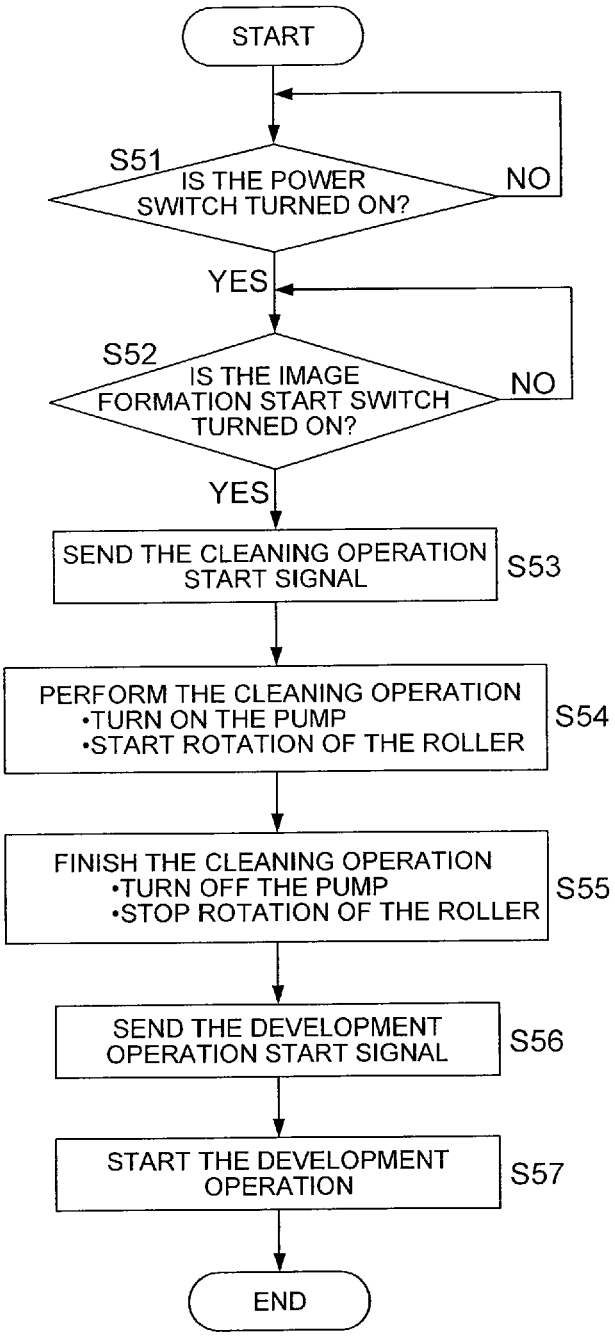

(e) In the flow of FIG. 9, when the user turns on the power switch of the image forming apparatus in step S51, and further turns on the image formation start switch (the print start switch) in step S52, a signal to turn on a cleaning operation is transmitted to the drive member in step S53 to conduct a cleaning operation in step S54. When cleaning has been conducted for a predetermined time period, the cleaning operation is finished in step S55, and a signal to turn on a development operation is transmitted in step S56 to start development in step S57.

Figure 10:
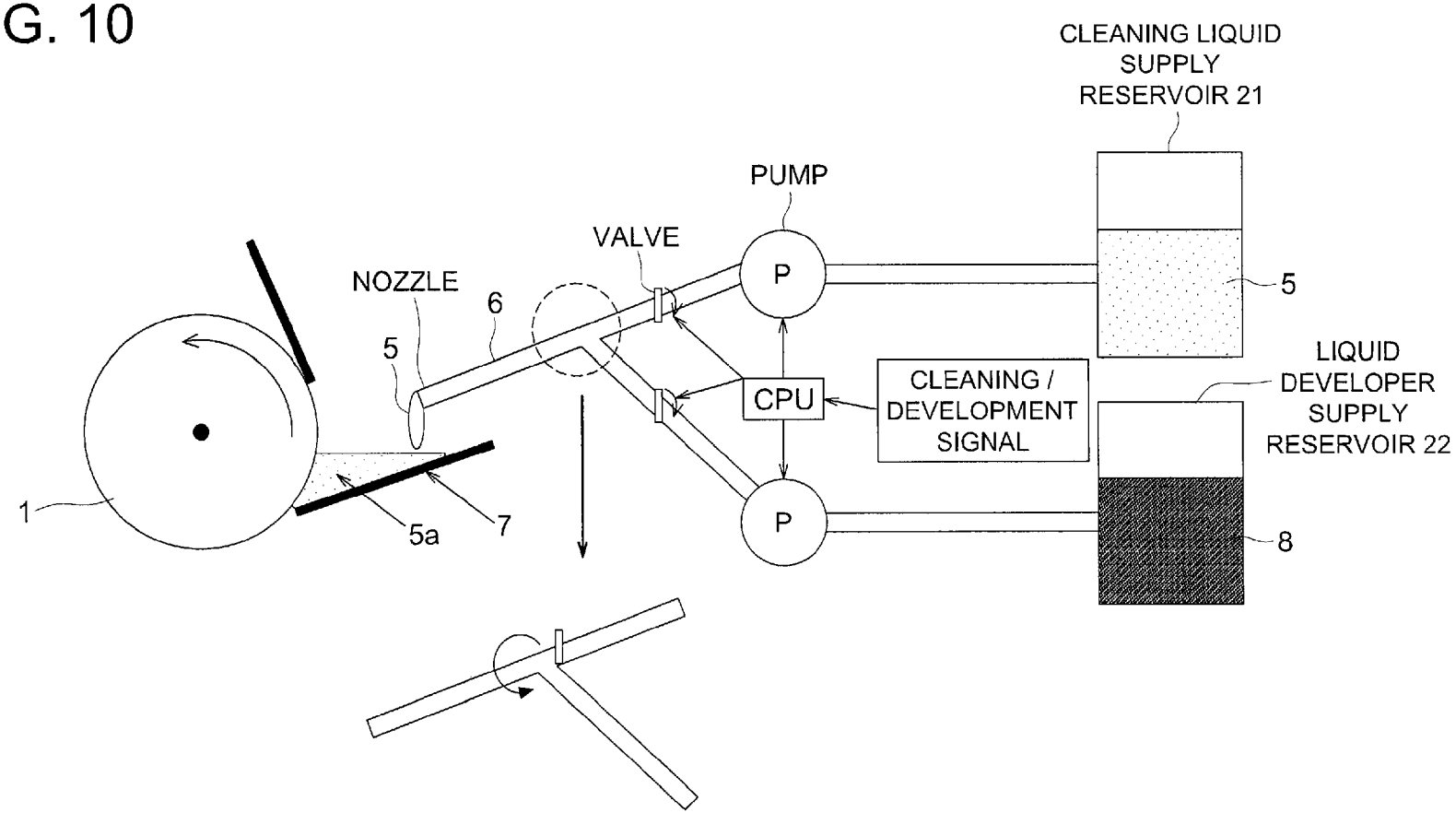
FIG. 10 is a drawing of a schematic constitution showing a control system to switch between development and cleaning, wherein a cleaning liquid supply member functions also as a liquid developer supply member.
Figure 11:
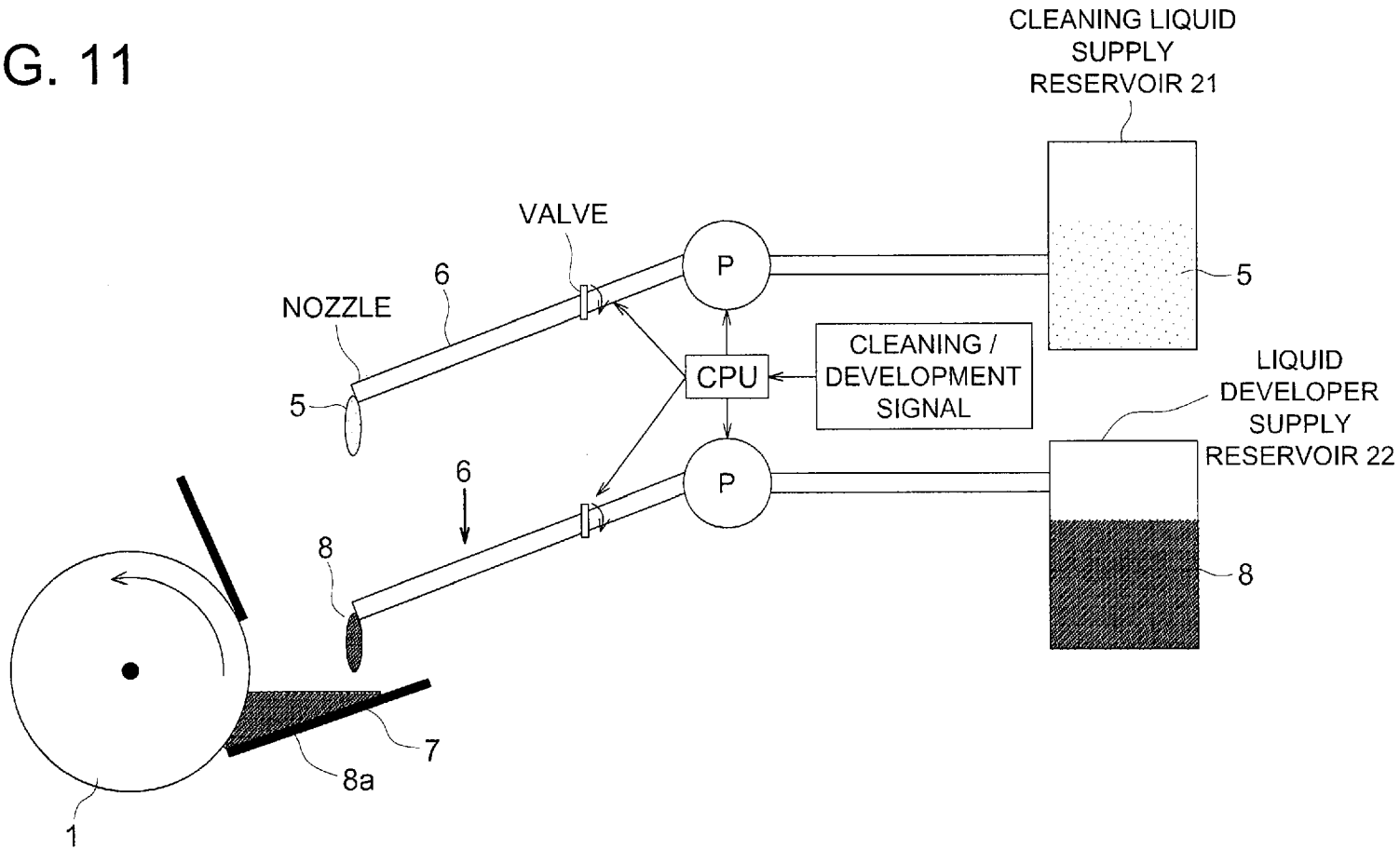
FIG. 11 is a drawing of a schematic constitution showing a control system to switch between development and cleaning, wherein a liquid developer supply member and a cleaning liquid supply member are separately arranged.

FIG. 10 is a schematic configuration diagram showing an example of a switching operation from the image forming (development operation) to the cleaning operation. In each of the liquid developer supply reservoir 22 and the cleaning liquid supply reservoir 21, provided is a pump to pump up the liquid developer 8 or cleaning liquid 5 to be supplied to the liquid developer/cleaning-liquid supply member 6. During an image formation (development operation), a bladed wheel in a pump on the developer supply reservoir 22 side is rotated and a valve in a supply path is opened, both controlled by a signal from a central processing unit CPU, and thus, the liquid developer 8 in the developer supply reservoir 22 is pumped up and supplied to the liquid developer/cleaning-liquid supply member 6. At this time, since a bladed wheel of the pump on the cleaning liquid supply reservoir 22 side is kept stopped and a valve in the supply path is closed, the cleaning liquid 5 is never supplied to the liquid developer/cleaning-liquid supply member 6. Similarly, in the cleaning operation, control is made so that the cleaning liquid 5 is pumped up from the cleaning liquid supply reservoir 21 to be supplied to the liquid developer/cleaning-liquid supply member 6 and the liquid developer 8 is never supplied to the liquid developer/cleaning-liquid supply member 6. Herein, in FIG. 10, each of the valves in supply paths is separately arranged in the path from the liquid developer supply reservoir 22 and in the path from the cleaning liquid supply reservoir 21; however, only one valve may be arranged at the crossing portion of the two paths within a dotted line to switch between supply and not-supply. Further, FIG. 11 shows an example in which the liquid developer/cleaning liquid supply-members are arranged separately for the liquid developer 8 and the cleaning liquid 5.

In the cleaning operation, the cleaning liquid 5 is ejected through the liquid developer/cleaning-liquid supply member 6. The cleaning liquid 5 is preferably the same liquid as carrier liquid of the liquid developer 8, however, it does not have to be the same liquid. For example, it may be appropriately selected from a hydrocarbon type (liquid paraffin), animal and vegetable oil, mineral oil, and the like.

In the cleaning operation, the cleaning liquid 5 is supplied and the cleaning may be conducted while the cleaning liquid 5 is being supplied, or the cleaning may be conducted after the cleaning liquid pool 5*a* has been formed with the cleaning liquid 5 having been supplied. In addition, the cleaning liquid may be supplied to the entire width of the liquid developer carrying area on the supply roller 1 at a time, or may be supplied at each part of the entire width sequentially.

"Cleaning" is referred here to an operation in which the cleaning liquid 5 pooled on the pool forming blade 7 is brought in contact with the first supply roller 1 for a predetermined period of time or longer.

The cleaning is here generally conducted while the first supply roller 1 is being rotated. In the cleaning operation, in order to improve cleaning efficiency, it is preferable to make the rotation speed of the first supply roller lower than at the time of image formation or to make the rotation in the opposite direction.

Further, the cleaning is performed more efficiently by applying ultrasonic waves, swinging the regulation blade 4 left and right, or changing the supply direction of the cleaning liquid, at the time of the cleaning.

In order to increase the effect of the cleaning, it is important to form a certain amount or more of the liquid pool 5*a* of the cleaning liquid 5. For that purpose, it is necessary to keep a balance between the amount of the cleaning liquid supplied to the pool forming member 7 and the amount of the cleaning liquid leaking from there.

Since the cleaning liquid 5 has a viscosity lower than that of the liquid developer 8, the cleaning liquid 5 leaks more through the gap between the pool forming blade 7 and the first supply roller 1 than the liquid developer 8. Therefore, different from in the image forming operation (during development operation), in the time of cleaning operation it is necessary to change the settings of the adjustment parameters so that a certain amount or more of the cleaning liquid pool 5*a* is formed on the pool forming blade 7. In particular, at the time of the cleaning, as described above, to increase cleaning efficiency, it is preferable to slow down the rotation speed of the first supply roller 1 or to rotate the first supply roller 1 in the reverse direction. However, when the rotation speed is made low, the cleaning liquid 5 leaks more through the gap of the pool forming blade 7, and thus, the pooling amount per unit time becomes smaller and the cleaning liquid 5 needs to be supplied more. Further, if the supply roller 7 is rotated in the reverse direction, the cleaning liquid is conveyed in the reversed direction, so that more cleaning liquid leaks through the gap. Even in these cases, it is necessary to adjust parameters so that a certain amount or more of the liquid pool 5*a* of the cleaning liquid 8 is formed constantly on the pool forming blade 7. Herein, a "certain amount" is referred here not to a particular amount, but an amount enough to clean.

The above-described adjustment parameters include:

(1) the supply amount of the cleaning liquid per unit time (supply rate);

(2-1) the width of the gap between the pool forming blade 7 and the supply roller 1; and (2-2) presence or absence of seals at the both ends of the pool forming blade 7.

In particular, in order to form the cleaning liquid pool 5*a* of a certain amount, the parameters can be set as follows:

(1) The supply amount of the cleaning solution per unit time (supply rate) at the time of the cleaning is made to be greater than the supply amount of a liquid developer per unit time (supply rate) at the time of the image formation.

a) Generally, the viscosity of the cleaning liquid is lower than that of the liquid developer, and the cleaning liquid leaks more through the gap between the supply roller 1 and the pool forming blade 7 than the liquid developer. To form the liquid pool 5*a* of a certain amount even in that case, the supply amount of cleaning liquid 5 per unit time is increased. The lower the viscosity of the cleaning liquid, the more increased is the supply amount.

b) As described above, in the case of making the rotation speed of the first supply roller 1, or reversing the rotating direction of the first supply roller 1 at the time of the cleaning operation, the amount of the cleaning liquid leaking through the gap between supply roller 1 and the pool forming blade 7 becomes large. To maintain the liquid pool of a certain amount even with the leaking, the supply amount is increased.

(2-1) The gap at the time of the cleaning is made to be narrower than at the time of the image formation.

As described in above item (1), when the viscosity of the cleaning liquid is low, and when the rotation speed of the first supply roller 1 is made low, or the first supply roller 1 is rotated in the reverse direction at the time of cleaning, the cleaning liquid easily leaks. Therefore, by making the gap narrower so as to limit the leakage, it is possible to form the liquid pool 5*b* of a certain amount.

(2-2) A seal is set up at the time of the cleaning, and the seals are unset at the time of the image formation.

As described in above item (1), when the viscosity of the cleaning liquid is low, and when the rotation speed of the first supply roller 1 is made low or the first supply roller 1 is rotated in the reverse direction at the time of the cleaning, the cleaning liquid easily leaks. Therefore, by setting up the seals on both edges of the pool forming blade 7 so as to limit the leakage, it is possible to form the cleaning liquid pool 5*a* of a certain amount.

Figure 12:
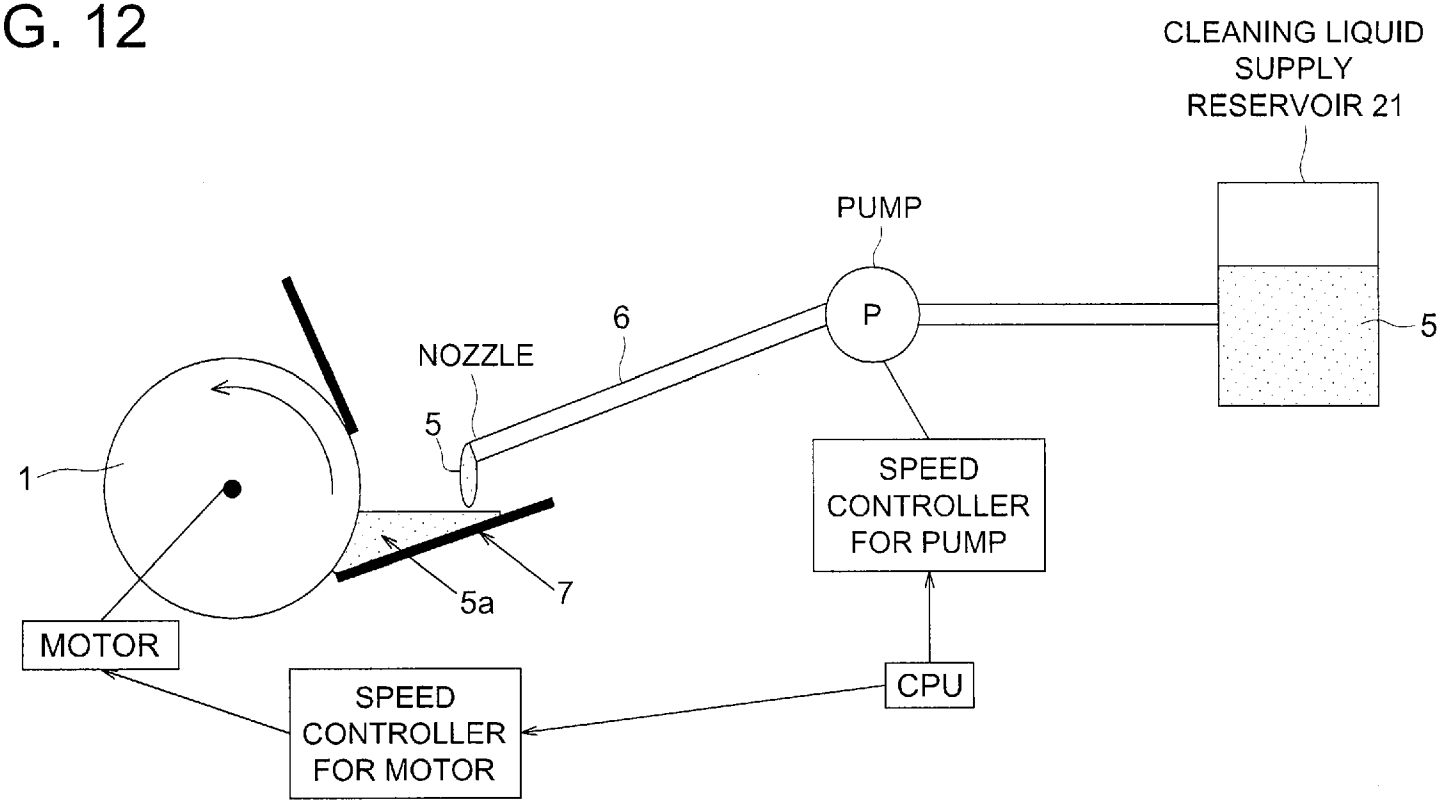
FIG. 12 is a drawing of a schematic constitution showing a control system to change the supply amount of a cleaning liquid and the rotation speed of a supply roller.
Figure 13:
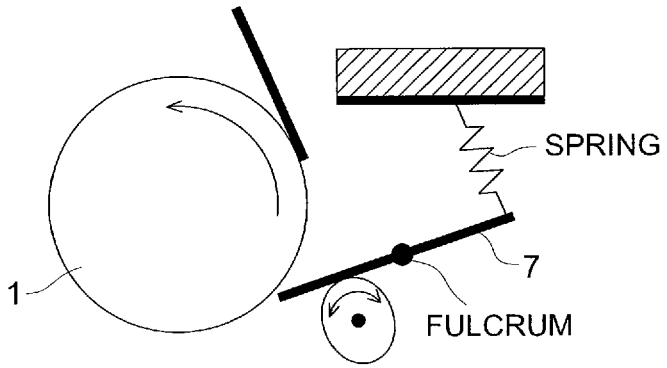
FIG. 13 is a drawing of a schematic constitution showing a mechanism to adjust a gap between a supply roller and a pool forming member.

FIG. 12 is a diagram of a schematic configuration showing a constitution example of a system to control the supply amount of the cleaning liquid and the rotation speed of the first supply roller 1. To pump up the cleaning liquid 5 from the cleaning liquid supply reservoir and supply it to the liquid developer/cleaning-liquid supply member 6, a pump and the like is arranged between the cleaning liquid supply reservoir and the liquid developer/cleaning-liquid supply member 6. This pump may include two pumps, one provided for a cleaning liquid and another for a liquid developer, or may be one pump provided for both purposes. When the cleaning operation is on based on a signal from the central processing unit CPU, the bladed wheel in the pump rotates, and the cleaning liquid 5 is pumped up from the cleaning liquid supply reservoir, and is sent to the liquid developer/cleaning-liquid supply member 6. The rotation speed of the bladed wheel is controlled so as to be higher in the case of increasing the supply amount and to be lower in the case of decreasing the supply amount. Similarly, based on a signal from the central processing unit CPU, the rotation speed and the rotation direction of the motor to rotate the first supply roller 1 is controlled, whereby the rotation speed and the rotation direction of the first supply roller 1 is controlled. In particular, at the time of the cleaning, the control is performed so as to set the rotation speed lower than at the time of the image forming, or reverse the rotation direction FIG. 13 is a diagram of a schematic configuration showing an example of a method for adjusting the gap between the first supply roller 1 and the pool forming blade 7. As illustrated in FIG. 13, the pool forming blade 7 swings around the fulcrum. An elliptical cam contacts and holds the first-supply-roller side of the fulcrum of the pool forming blade 7, and prevents downward movement of the first-supply-roller side of the fulcrum, which movement is caused by the force of a spring, thereby fixing the gap between the first supply roller 1 and the pool forming blade 7. The opposite side, of the fulcrum, of the pooling blade 7 is urged upward. When the small diameter part of the circumference of the cam approaches to the pool forming blade 7 by the rotation of the elliptical cam, the supply-roller-side, of the fulcrum, of pool forming blade 7, descends by the force of the spring, and as a result, the gap between the first supply roller 1 and the pool forming blade 7 is widened. On the other hand, when the large diameter part of the circumference of the elliptical cam approaches to the pool forming blade 7, the pool forming blade 7 is pushed upward around the fulcrum against the downward force of the spring, and the gap between the first supply roller 1 and the pool foaming blade 7 is narrowed.

Figure 14:
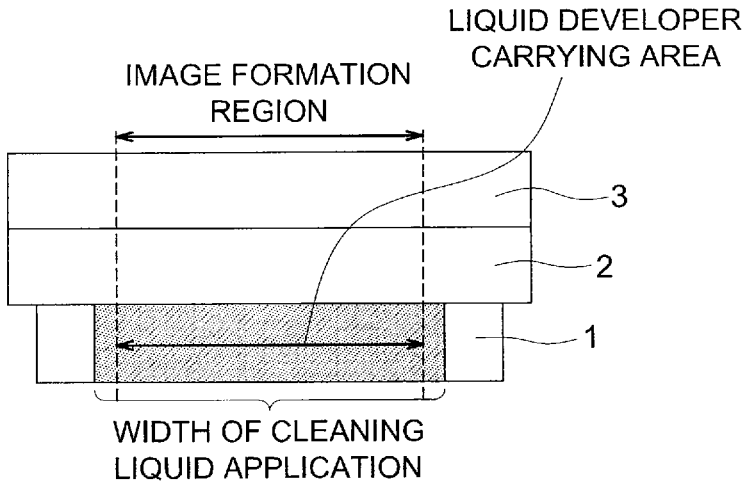
FIG. 14 is a diagram of a schematic configuration showing a relationship between a coating width of a cleaning liquid and an image forming region in the liquid development apparatus of FIG. 2.

When the supply amount of the cleaning liquid is changed, it is preferable to increase the amount by 30% or more than the supply amount of the liquid developer at the time of the image formation. It is more preferable to increase by 50% or more. It is preferable to change the gap between the pool forming blade 7 and the supply roller 1 by 0.5 mm or more. Point is that it is important to keep the balance between the amount of the supplied liquid and the amount of the leaking liquid so as to keep the state that the pool of the cleaning liquid 5 is formed between the pool forming blade 7 and the supply roller 1. Herein, in order to sufficiently clean off the liquid developer 8 remaining on the supply roller 1, it is necessary that the cleaning liquid 5 is applied to entirely at least the width, of the liquid-developer-carrying region, in the rotation axis direction of the first supply roller 1, which width corresponds to the width, of the image-forming region, in the rotation axis direction of the image carrier. FIG. 14 shows the relationship between the image forming region and a width of a region to which the cleaning liquid 5 is applied. The width of the region on the supply roller 1 to which cleaning liquid 5 is applied is larger than the width of the image forming region.

As described above, in the liquid development apparatus according to this embodiment, the liquid developer/cleaning-liquid supply member 6 supplies the cleaning liquid 5 on the pool forming blade 7 at a predetermined timing during the non-development operation to form the suitable liquid pool 5*a* of the cleaning liquid, whereby the liquid developer remaining on the surface of the first supply roller 1 is removed and cleaned. Thus, it is not necessary to add any member such as a cleaning liquid supply member to efficiently remove contamination by the liquid developer so as to control variation in a regulated amount of the liquid developer and adverse effects on image quality.

Figure 15:
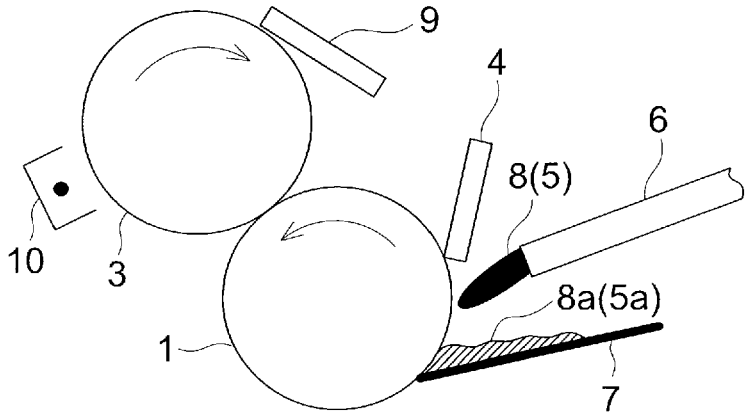
FIG. 15 is a drawing of a schematic constitution showing another constitution example of a liquid development apparatus according to an embodiment.

As another embodiment, as shown in FIG. 15, possible is a constitution in which the second supply roller 2 is omitted and the liquid developer 8 is supplied to the development roller 3 directly from the first supply roller 1. Also in this case, by performing the cleaning operation similarly to the above-described constitution, similar effects can be achieved.

(Developer)

Liquid developer will now be explained. Liquid developer is comprised of at least carrier liquid, colored fine particles (toner particles) and dispersant.

(Carrier Liquid)

Carrier liquid has a low dielectric constant of not more than 3, and selected from those liquids having a high electrical insulation capabilities. For example, it is selected from a hydrogen carbide type (liquid paraffin), animal and vegetable oil, and mineral oil, and such a carrier liquid has a long chain alkyl group in molecules.

For example, there are listed White Oil (P-40, P-70, P-120 and P-400) manufactured by Matsumura Oil Co., Ltd., IP Solvent from Idernitsu Kosan Co., Ltd. and Isoper (G, H and L) from Exxon Mobile Corp. Further, vegetable oil (soybean oil, linseed oil and tong oil) and silicone oil are also used.

From the viewpoint of insulation properties and charge retaining properties, a hydrogen carbide type (liquid paraffin) is more preferable than vegetable oil. Since in this embodiment, the developer is applied to a development apparatus which provides charges to the developer with a charger, if the charge retaining properties are low, the charging ability of the toner is inconveniently low.

<Toner>

Toner particles for developer suitable for the present embodiments are comprised of at least colorant and binder resin.

As the binder resin, thermoplastic resin is used. The thermoplastic resin includes polyester resin, styrene-acryl resin, epoxy resin, however, and the like, without being limited thereto. Among them, polyester resin is preferable because of having a sharp-melting property.

The polyester resin is prepared by polycondensation of polybasic acid and polyhydric alcohol.

The polybasic acid includes isophthalic acid, terephthalic acid, malonic acid, succinic acid, adipic acid, azelaic acid, sebacic acid, fumalic acid, maleic acid, itaconic acid and acid unhydrides thereof; trimellitic acid, trimesic acid, pyromellitic acid, and the like.

Polyhydric alcohol, although not limited thereto, includes ethylene glycol, diethylene glycol, triethylene glycol, propylene glycol such as 1,2-propylene glycol, dipropylene glycol, butane diol such as 1,4-butane diol, alkylene glycol (aliphatic glycol) such as neopentyl glycol and 1,6-hexane diol and alkyleneoxide adducts thereof, bisphenols such as bisphenol A and hydrogenated bisphenol, phenol type glycols of alkyleneoxide adducts thereof; aliphatic diol and aromatic diol such as monocyclic or polycyclic diol, and triol such as glycerin and trimethylol propane. These may be used alone or by being mixed with two types or more.

By polycondensation of the above-described polybasic acid and polyhydric alcohol, desired polyester resin can be prepared. As a method for polycondensation, a method for polycondensation well known in the art can be used. Although it depends on the kind of a starting material monomer, the polycondensation is generally performed under a temperature of 150 to 300° C. Further it can be performed under an arbitrary condition, for example, using a various solvent and setting the pressure in the reaction vessel to be at an ordinary pressure or a reduced pressure. In order to promote the reaction, an esterification catalyst may be used. As an esterification catalyst, an organometalic compound such as tetrabutyl zirconate, zirconium naphtate, tetrabutyl titanate, tetraoctyl titanate, and 3/1 oxalic tin/sodium acetate can be used, however, preferable are those which do not color the produced ester. Further, alkyl phosphate, ally phosphate, and the like may be used as a catalyst or a color adjusting agent.

To control the molecular weight of the produced polyester resin, a polymerization temperature, a pressure of the reaction system and a reaction time may be adjusted. Further, the acid value can be controlled depending on the mole ratio of carboxylic acid to alcohol for the reaction, the molecular weight of a polymer, and the like. Further, as binder resin, other than polyester resin, styrene-acryl copolymer, styrene-acryl modified polyester resin, polyolefin copolymer (particularly ethylene type copolymer), epoxy resin, rosin modified phenol resin, rosin modified maleic acid resin, paraffin wax, and the like may be appropriately used by being mixed at a suitable amount in a range of not more than 30 mass % of the total weight of resin.

The pigment includes furnace black, lamp black, acetylene black, channel black, C. I. Pigment Black, Ortho-Aniline black, Toluidine Orange, Permanent Carmine FB, furnace yellow AAA, dis-azo orange PMP, Lake Red C, Brilliant Carmine 6B, Phthalocyanine Blue, Quinacridone Red, C. I. Pigment Blue, C. I. Pigment Red. C. I. Pigment Yellow, dioxane violet, Victoria Pure Blue, Alkali Blue Toner, Alkali Blue R Toner, First Yellow 10G, Ortho-Nitroaniline Orange, Toluidine Red, Barium Red 2B, Calcium Red 2B, Pigment Scarlet 3B Lake, Ansocine 3B Lake, Rhodamine 6B Lake, Methyl-violet Lake, Basic Blue 6B Lake, Fast Skyblue, Reflex Blue G, Briliant Green Lake, Phthalocyanine Green G, Prussian blue, ultramarine, ion oxide powder, zinc flower, calcium carbonate, clay, barium sulfate, alumina white, aluminum powder, daylight fluorescent pigment, pearl pigment, and the like.

Further, to improve pigment dispersibility, pigment derivatives may be used. The pigment derivatives provided with a desired functional group such as a carboxyl group, a sulfonic group, an hydroxyl group, an amino group and an amide group can be used.

The pigment is dispersed in resin, and the secondary particle size is not less than 50 nm and not more than 1 μm and preferably not less than 50 nm and not more than 300 nm. When the secondary particle size is greater than this upper limit, sufficient coloring, opacity and transparency after fixing are hardly achieved even with a predetermined appropriate coating amount.

The blending amount of a pigment is not less than 3 mass % and not more than 50 mass % with respect to the resin, and preferably not less than 5 mass % and not more than 30 mass %. A desired density cannot be obtained for less than 3 mass %, and there is a possibility of causing deterioration of dispersibility in resin and deterioration of fixing ability for over 50 mass %.

Next, colored and kneaded mixture, which comprises the thus prepared binder resin, the appropriately added colorant, and the like, is roughly ground by use of a cutter mill or a jet mill, and the resulting roughly ground toner is further subjected to wet grinding in a carrier liquid so as to be finely ground to make a volume average particle size of toner of 0.1 to 10 μm and preferably 0.5 to 5 μm, whereby a concentrated liquid developer is prepared.

The concentrated liquid developer prepared in this manner is subjected to a dilution and dispersion treatment with a carrier liquid appropriately containing a charge control agent, a dispersant (a dispersion stabilizer), and the like to make a suitable concentration.

<Dispersant>

As a dispersant, there can be used polyalkylene polyamine, salt of long chain polyaminoamide with high molecular weight acid ester, salt of polyaminoamide with polar acid ester, modified polyurethane, polyester polyamine, and the like.

Specific examples of the dispersant include "Anti-Terra-U (polyaminoamide phosphate)", "Anti-Terra-204 (high molecular weight polycarboxylate)", "Disperbyk-101 (polyamide phosphate and acid ester)" and "Disperbyk-130 (polyamide)", manufactured by BYK Chemie GmbH.

And, there are listed 13940 (polyester amine type), 17000, 18000 and 19000 (fatty acid amine type), 11200, manufactured by Avicia Inkjet Ltd, and the like.

Further, there are listed V-216, V-220 and WP-660 (polyvinyl pyrrolidone having a long chain alkyl group) from ISP Inc, and the like.

As the pigment dispersant, a basic polymer dispersant is used, and in particular, those having an amino group, an imino group, an amide group or a pyrrolidone are preferred.

The polymer dispersants described above are preferably added at 1 to 100 mass % with respect to the toner particles.

The dispersibility will be decreased in the case of less than 1 mass %, and the conductivity of the liquid will be raised to cause problems in charging ability in the case of over 100 mass %.

In a liquid development apparatus according to the present embodiment, a liquid developer/cleaning liquid supply member supplies cleaning liquid on a pool forming member at a predetermined timing during a non-development operation to form a suitable pooling portion of the cleaning liquid, whereby liquid developer remaining on the surface of a supply roller is removed and cleaned. As a result, it is possible to efficiently remove contamination by liquid developer and to prevent variation in a regulated amount of the liquid developer and adverse effects on image quality.

A method for manufacturing toner is not limited to a grinding method, and a granulation method such as polymerization in liquid and a dissolution evaporation method can be used.

EXAMPLES

Examples of the present invention will be explained.

In the following explanation, "Mw" represents "weight average molecular weight", "Mn" represents "number average molecular weight" and "Tg" represents "glass transition temperature".

Mw and Mn each were calculated from the results of gel permeation chromatography. Gel permeation chromatography was performed by use of high speed liquid chromatograph pump TR1 ROTAR-V Type (manufactured by Nippon Bunko Co., Ltd.), ultraviolet photospectrometer UVIDEC-100-V (manufactured by Nippon Bunko Co., Ltd.) and column of 50 cm long Shodex GPC A-803 (manufactured by Showa Denko Co., Ltd.), and the molecular weight of a test sample was calculated and determined as polystyrene converted Mw and Mn, from the results of chromatography using polystyrene as a standard substance. Herein, as a test sample, 0.05 g of binder resin dissolved in 20 ml of tetrahydrofran (THF) was used.

Glass transition temperature (Tg) was measured by use of calorimeter DSC-20 (manufactured by Seiko Electronics Industry Co., Ltd.) under a condition of sample amount of 35 mg and a temperature raising rate of 10° C./min. The acid value was measured according to JIS K5400 method.

<Manufacture of Resin>

A method for manufacturing polyester resin will be explained.

In a round bottom flask equipped with a reflux condenser, a water-alcohol separator, a nitrogen gas introducing tube, a thermometer and a stirrer, 1,600 mass parts of a polypropyleneoxide adduct of bisphenol A, 550 mass parts of terephthalic acid (polybasic acid) and 340 mass parts of trimellitic acid were charged, nitrogen gas being introduced with stirring, and dehydration polycondensation or dealcoholation polycondensation was performed at 200 to 240° C. At the time when the acid value of polyester resin or the viscosity of the reaction solution becomes a predetermined value, the temperature of a reaction system was lowered to not higher than 100° C. to stop polycondensation. In this manner, thermoplastic resin was prepared.

The prepared polyester resin had Mw=7,500, Mn=2,700, Tg=62.3° C. and acid value=64.0 mg KOH/g.

<Manufacture of Liquid Developer>

Resin of 100 mass parts and 15 mass parts of cupper phthalocyanine were mixed, followed by being sufficiently mixed by a Henschel Mixer; then the system was melting mixed by a biaxial extruding kneader, being cooled, thereafter, being roughly ground and finely ground by a jet grinder to achieve a mean particle size of 6 μm.

The toner particles of 25 mass % prepared above were blended with 1 mass part of V-216 (manufactured by IPS Corp.) as a polymer dispersant, 75 mass % of IP Solvent 2028 (a flush point of 82° C., manufactured by Idemitsu Kosan Co., Ltd.), which is liquid paraffin, and 100 mass % of zirconia beads; and the system was stirred by a sand mill for 120 hours to prepare liquid developer. The mean particle size of the liquid developer (toner) was 2.6 μm.

<Image Output Condition>

The liquid developer above prepared was supplied to the pool forming blade 7 in the apparatus having a constitution shown in FIG. 1, the apparatus being driven for 4 hours, and image output was conducted.

Apparatus conditions of the image output were as follows.

The pool forming blade 7 was made of resin and had a thickness of approximately 2 mm. Liquid developer 8 was supplied on the pool forming blade 7 from the nozzle of the liquid developer/cleaning-liquid supply member 6.

The liquid developer 8 was supplied to the first supply roller 1 from the liquid pool 8*a* formed on the pool forming blade 7. As the first supply roller 1, an anilox roller whose surface was provided with grooves was used. The anilox roller 1 used had a diameter of 40 mm and the depth of the grooves of 30 μm.

The liquid developer amount on the anilox roller 1 was regulated by the regulation blade 4.

The second supply roller 2 had a diameter of ϕ40 mm and rotated in the same direction and at the same speed at the nip portion as the anilox roller 1. That is, the anilox roller was driven by the second supply roller 2 and was not provided with a driving apparatus.

On the other hand, the second supply roller 2 rotated in the direction opposite to that of the development roller 3 at the nip potion.

As the development roller 3, a metal shaft having a diameter 20 mm covered with polyurethane rubber having a hardness of 30 degree (JISA) at a thickness of 6 mm on which polyurethane resin of 10 μm coated was used.

As the second supply roller 2, a metal shaft having a diameter of 28 mm covered with polyurethane rubber having a hardness of 50 degree at a thickness of 6 mm was used.

The development roller 3 and the second supply roller 2 had an indentation amount of 0.1 mm, and the second supply roller 2 and the anilox roller 1 had an indentation amount of 0.4 mm.

Further, the polyurethane rubber having a thickness of 2 mm was used as the cleaning blade 9, and the blade made of stainless steel having a thickness of 0.15 mm was used as the regulation blade 4.

As for the line speed of each roller, the development roller 3 rotated at 400 mm/sec, the second supply roller 2 rotated at 500 mm/sec and the anilox roller 1 rotated at 500 mm/sec.

An image was formed under the standard conditions of the development and the transfer (a development: 400 V, a first transfer potential difference: 500 V, and a secondary transfer potential difference: 2 kV).

Comparative Example 1

Image output was continued for 4 hours on the above-described apparatus and under the above-described conditions. The transmission density (TD) of toner on a solid image portion of the latest image output (paper: OK Top Coat Plus 128 g, manufactured by Oji Paper Co., Ltd.) immediately before stopping the operation of the apparatus was measured by use of a transmission densitometer X-rite and was TD=1.2.

Thereafter, the apparatus was left standing for 72 hours, and image formation was conducted under the same output condition, and its transmission density was measured. The transmission density was TD=0.8, and there was observed an image noise arising from the remaining liquid developer without being cleaned on the roller.

Example 1

Image formation was continued for 4 hours on the above-described apparatus and under the above-described condition. The transmission density of toner on a solid image portion of the latest image output (paper: OK Top Coat Plus 128 g, manufactured by Oji Paper Co., Ltd.) immediately before stopping the operation of the apparatus was measured by use of the transmission densitometer manufactured by X-rite, and was TD=1.2.

A cleaning operation was set to be conducted immediately after stopping drive. The rotation speed of an anilox roller at the time of the cleaning operation was 500 mm/see, and when the cleaning liquid 5 was supplied from the cleaning liquid supply member 6 on the pool forming blade 7 at 1.5 L/min, each portion of a liquid developer carrying area on the anilox roller 1 was supplied, on a width basis, with the cleaning liquid 5 in the liquid pool 5*a* of the cleaning liquid 5.

As the cleaning liquid 5, Carrier liquid IP Solvent 2028 for the liquid developer 8 was used as the cleaning liquid 5, and the cleaning time was set to 5 minutes. The cleaning liquid 5 was recovered into a recovering bath to be recycled.

The liquid developer/cleaning-liquid supply member 6 (FIG. 4) was a metallic cylinder having 6 holes and the gap between itself and the anilox roller 1 was set to 20 mm.

The gap between the pool forming blade 7 and the anilox roller 1 was 1.0 mm.

After the apparatus was left standing for 72 hours thereafter, the image formation under the same image output condition was conducted, as a result, the transmission density was measured and was TD=1.12, and no image noises arising from the remaining liquid developer on the anilox roller without being cleaned were observed.

Example 2 to Example 5

Every one of these examples was similar to example 1; however conditions changed between image forming operations and the cleaning operations were different.

The amount of the cleaning liquid for example 2, the gap (Gap) between the anilox roller 1 and the pool forming blade 7 for example 3, presence or absence of the side seals for example 4 and the rotation speed and the supply amount of the cleaning liquid for example 5, each condition in the cleaning operation were changed from the conditions at the time of image formation.

In every case, the conditions were changed so that the cleaning liquid 5 is supplied, on a width basis, on each portion of the liquid developer carrying area on the anilox roller 1 in the liquid pool 5*a* of the cleaning liquid 5 formed on the pool forming blade 7.

As for the details of the conditions and the evaluation results, see table 1, which will be described later.

Example 6

Example 6 was similar to example 2; however, the liquid pool 5*a* was subjected to ultrasonic waves.

As for the details of the conditions and the evaluation results, see table 1 which will be described later.

Example 7

Example 7 was similar to example 2; however, regulation blade 4 was moved left and right at the time of the cleaning.

As for the details of the conditions and evaluation results, see table 1 which will be described later.

Example 8

Example 8 was similar to example 3; however, the image forming apparatus was first made to be in a stop state at the time of the cleaning and ultrasonic waves were applied to the liquid pool 5*a* for 5 minutes, thereafter example 8 was the same as example 3.

As for the details of the conditions and the evaluation results, see table 1 which will be described later.

(Evaluation Result)

The evaluation results of each example and comparative example are shown in table 1.

Herein, as for how the cleaning liquid 5 fills in the liquid pool 5*a* on the pool forming blade 7, "A" in the column "How cleaning liquid fills" of Table 1 represents the state in which each part in the width direction of the carrying-portion, which is for the area for carrying the liquid developer 8, is once filled with the cleaning liquid 5.

Further, with respect to an effect of the cleaning (high stability of density), it was measured based on a TD variation rate, which is the ratio of TD after being left standing for 72 hours to TD before left standing.

The TD variation rate was evaluated according to the following criteria.

A: Excellent with the TD variation rate of 0.95 or higher;

B: Good with the TD variation rate of 0.9 or higher and less than 0.95; and

D: Poor with the TD variation rate of less than 0.9:

TABLE 1

| | At the time of image formation | | | | At the time of cleaning operation | | | | | | | | |
|---|---|---|---|---|---|---|---|---|---|---|---|---|---|
| | Supply amount (L/min) | Side seal | Rotation speed | Gap (mm) | Supply amount (L/min) | Side seals | Rotation speed | Gap (mm) | How cleaning liquid fills | Before-left-standing TD | After-left-standing TD | TD variation rate | Stability of density |
| Example 1 | 1 | none | 500 | 1 | 1.5 | none | 500 | 1 | A | 1.2 | 1.12 | 0.93 | B |
| Example 2 | 0.3 | yes | 500 | 1 | 0.6 | none | 500 | 1 | A | 1.2 | 1.1 | 0.92 | B |
| Example 3 | 0.3 | yes | 500 | 1 | 0.3 | yes | 500 | 0.5 | A | 1.2 | 1.09 | 0.91 | B |
| Example 4 | 1 | none | 500 | 1 | 1 | yes | 500 | 1 | A | 1.2 | 1.12 | 0.93 | B |
| Example 5 | 0.3 | yes | 500 | 1 | 0.8 | yes | 250 | 1 | A | 1.2 | 1.09 | 0.91 | B |

TABLE 1-continued

| | At the time of image formation | | | | At the time of cleaning operation | | | | | | | | |
|---|---|---|---|---|---|---|---|---|---|---|---|---|---|
| | Supply amount (L/min) | Side seal | Rotation speed | Gap (mm) | Supply amount (L/min) | Side seals | Rotation speed | Gap (mm) | How cleaning liquid fills | Before-left-standing TD | After-left-standing TD | TD variation rate | Stability of density |
| Example 6 | 0.3 | yes | 500 | 1 | 0.6 | none | 500 | 1 | A | 1.2 | 1.18 | 0.98 | A |
| Example 7 | 0.3 | yes | 500 | 1 | 0.6 | none | 500 | 1 | A | 1.2 | 1.18 | 0.98 | A |
| Example 8 | 0.3 | yes | 500 | 1 | 0.3 | yes | 500 | 0.5 | A | 1.2 | 1.2 | 1.00 | A |
| Comparative Example 1 | 1 | none | 500 | 1 | none | | | | | 1.2 | 0.8 | 0.67 | D |

It is clear from table 1 that, to obtain a desired cleaning effect (high stability of density), the conditions for the cleaning operation should be changed from the conditions for the image formation so that each portion of liquid developer carrying area on the anilox roller 1 is filled with the cleaning solution 5 in the liquid pool 5*a* on the pool forming blade 7.

As described above, in the liquid development apparatus according to the embodiment, a liquid developer/cleaning-liquid supply member supplies cleaning liquid on the pool forming member at a predetermined timing during non-development operation to form the suitable pooling portion of the cleaning liquid, whereby the liquid developer remaining on the surface of the supply roller is removed and cleaned. As a result, without adding a specific cleaning liquid supply member and the like, the contamination by the liquid developer is removed, and the variation in the amount of a regulated liquid developer is controlled, thereby reducing adverse effects on image quality.

Herein, the above-described embodiment is only an example in every aspect and not restrictive. The scope of the present invention is defined by the appended claims not by the above description and it is intended that the meaning equivalent to and every modifications within the scope of the claims are included in the present invention.

What is claimed is:

1. A liquid development apparatus comprising:

a development roller configured to carry on a surface thereof a liquid developer including a carrier liquid and toner particles dispersed therein, and to convey the liquid developer onto an image carrier to develop an electrostatic latent image formed on the image carrier;

a supply roller configured to carry on a surface thereof the liquid developer and supply the liquid developer onto the development roller;

a pool forming member provided facing the supply roller, and configured to form a pool of the liquid developer or the cleaning liquid thereon to supply the liquid developer or the cleaning liquid onto the supply roller, respectively, wherein there is a gap between the pool forming member and the supply roller;

a cleaning liquid supply member configured to supply the cleaning liquid onto the pool forming member to form a pool of the cleaning liquid thereon, thereby performing a cleaning operation in which the cleaning liquid is supplied to the pool forming member to form the pool of the cleaning liquid thereon so as to clean and remove the liquid developer remaining on the surface of the supply roller at a certain time while a development operation to develop an electrostatic latent image with the liquid developer is not performed;

a controller configured to switch between the cleaning operation and the development operation; and a gap setting member configured to drive the pool forming member to set the gap between the pool forming member and the supply roller to have a predetermined distance, wherein the controller controls the gap setting member to set the gap between the pool forming member and the supply roller narrower when the cleaning liquid is supplied onto the pool forming member in the cleaning operation than when the liquid developer is supplied onto the pool forming member in the development operation.

2. A liquid development apparatus of claim 1, wherein the pool of cleaning liquid is formed to cover an entire width, of a liquid developer carrying area on the supply roller, in a direction of a rotating axis thereof.

3. A liquid development apparatus of claim 1, wherein the cleaning liquid supply member is configured to supply the liquid developer onto the pool forming member.

4. A liquid development apparatus of claim 1, further comprising: a liquid developer supply member configured to supply the liquid developer to form a pool of the liquid developer on the pool forming member.

5. A liquid development apparatus of claim 1, wherein the cleaning liquid contains a carrier liquid.

6. A liquid development apparatus of claim 1, wherein the cleaning liquid supply member is configured to supply the liquid developer onto the pool forming member, further comprising: a liquid developer supply reservoir to store the liquid developer; a cleaning liquid reservoir to store the cleaning liquid; and a valve provided among the liquid developer supply reservoir, the cleaning liquid reservoir, and the cleaning liquid supply member, and configured to selectively allow one of the liquid developer and the cleaning liquid to flow through the valve toward the cleaning liquid supply member, and wherein the controller controls the valve so as to selectively allow one of the liquid developer and the cleaning liquid to flow through the valve.

7. A liquid development apparatus of claim 1, further comprising: a liquid developer supply reservoir to store the liquid developer; a cleaning liquid reservoir to store the cleaning liquid; a liquid developer supply member configured to supply the liquid developer to form a pool of the liquid developer on the pool forming member; and a switching mechanism configured to allow the liquid developer to flow from the liquid developer supply reservoir to the liquid developer supply member, in the development operation; and to allow the cleaning liquid to flow from the cleaning liquid supply reservoir to the cleaning liquid supply member, in the cleaning operation, wherein the controller controls the switching mechanism to switch between the cleaning operation and the development operation.

8. A liquid development apparatus of claim 7, wherein the switching mechanism includes: a first valve provided between the liquid developer supply reservoir and the liquid developer supply member, and configured to allow or prohibit the liquid developer to flow through the first valve; and a second valve provided between the cleaning liquid reservoir and the cleaning liquid supply member, and configured to allow or prohibit the cleaning liquid to flow through the second valve, wherein the controller controls the first valve and the second valve so as to selectively allow one of the liquid developer and the cleaning liquid to flow through the first valve and the second valve, respectively.

9. A liquid development apparatus of claim 1 wherein the controller controls the supply roller to rotate slower in the cleaning operation than in the development operation, or controls the supply roller to rotate in a direction opposite to a rotating direction of the supply roller in the development operation.

10. A liquid development apparatus of claim 1, wherein the cleaning operation is initiated by a power-off signal input by a user, and the cleaning operation is completed before the apparatus is powered down.

11. A liquid development apparatus of claim 1, wherein the cleaning operation starts after a predetermined time has passed since completion of the development operation.

12. A liquid development apparatus of claim 1, wherein the cleaning operation is initiated by a predetermined signal to start the cleaning operation input by a user.

13. A liquid development apparatus of claim 1, wherein the cleaning operation starts just after the liquid development apparatus is powered up.

14. A liquid development apparatus of claim 1, wherein the cleaning operation starts after the liquid development apparatus is powered up, and completes just before the initial development operation starts.

15. A liquid development apparatus comprising:

a development roller configured to carry on a surface thereof a liquid developer including a carrier liquid and toner particles dispersed therein, and to convey the liquid developer onto an image carrier to develop an electrostatic latent image formed on the image carrier;

a supply roller configured to carry on a surface thereof the liquid developer and supply the liquid developer onto the development roller;

a pool forming member provided facing the supply roller, and configured to form a pool of the liquid developer or the cleaning liquid thereon to supply the liquid developer or the cleaning liquid onto the supply roller, respectively;

a cleaning liquid supply member configured to supply the cleaning liquid onto the pool forming member to form a pool of the cleaning liquid thereon, thereby performing a cleaning operation in which the cleaning liquid is supplied to the pool forming member to form the pool of the cleaning liquid thereon so as to clean and remove the liquid developer remaining on the surface of the supply roller at a certain time while a development operation to develop an electrostatic latent image with the liquid developer is not performed;

a controller configured to switch between the cleaning operation and the development operation, wherein, in the cleaning operation, the controller controls the cleaning liquid supply member to supply the cleaning liquid onto the pool forming member at a higher supply rate than a supply rate of the liquid developer to be supplied onto the pool forming member in the development operation.

16. A liquid development apparatus of claim 15, wherein the controller controls the supply roller to rotate slower in the cleaning operation than in the development operation, or controls the supply roller to rotate in a direction opposite to a rotating direction of the supply roller in the development operation.

17. A method of cleaning a supply roller for carrying and conveying a liquid developer including a carrier liquid and toner particles dispersed therein, toward an image carrier to develop an electrostatic latent image formed on the image carrier, the liquid developer being supplied to the supply roller by forming a pool of the liquid developer on a pool forming member facing the supply roller so that the pool of the liquid developer contacts the supply roller, said method comprising:

supplying a cleaning liquid onto the pool forming member in place of the liquid developer to form a pool of the cleaning liquid on the pool forming member so that the pool of the cleaning liquid contacts the supply roller, wherein there is a gap between the pool forming member and the supply roller;

rotating the supply roller to convey the cleaning liquid carried thereon; and setting the gap between the pool forming member and the supply roller narrower when the cleaning liquid is supplied onto the pool forming member than when the liquid developer contacts the supply roller.

18. A method of claim 17, wherein the cleaning liquid is supplied to the pool forming member so that the pool of the cleaning liquid covers an entire width, of a liquid developer carrying area on the supply roller, in a direction of a rotating axis thereof.

19. A method of cleaning a supply roller for carrying and conveying a liquid developer including a carrier liquid and toner particles dispersed therein, toward an image carrier to develop an electrostatic latent image formed on the image carrier, the liquid developer being supplied to the supply roller by forming a pool of the liquid developer on a pool forming member facing the supply roller so that the pool of the liquid developer contacts the supply roller, said method comprising:

supplying a cleaning liquid onto the pool forming member in place of the liquid developer to form a pool of the cleaning liquid on the pool forming member so that the pool of the cleaning liquid contacts the supply roller;

rotating the supply roller to convey the cleaning liquid carried thereon; and controlling the rate of supplying the cleaning liquid onto the pool forming member so as to be greater than a rate of supplying the liquid developer to the pool forming member during a development operation to develop the electrostatic latent image on the image carrier.

* * * * *